United States Patent [19]

Meyers

[11] 4,049,513

[45] Sept. 20, 1977

[54] TREATMENT OF CELL ANODES

[75] Inventor: Norman W. Meyers, Islington, Canada

[73] Assignee: Erco Industries Limited, Islington, Canada

[21] Appl. No.: 664,588

[22] Filed: Mar. 8, 1976

[30] Foreign Application Priority Data

Mar. 17, 1975 United Kingdom ..... 11048/75

[51] Int. Cl.[2] ..... C25B 11/10; C25B 1/26; C21D 1/00; C22C 5/04

[52] U.S. Cl. ..... 204/290 F; 204/95; 204/293; 75/172 R; 148/13

[58] Field of Search ..... 204/95.98, 290 F, 293; 75/172 R; 148/13

[56] References Cited

U.S. PATENT DOCUMENTS

| | | | |
|---|---|---|---|
| 2,406,172 | 8/1946 | Smithells | 75/172 R |
| 3,469,074 | 9/1969 | Cotton et al. | 204/290 F |
| 3,630,768 | 12/1971 | Bianchi et al. | 204/290 F |
| 3,684,543 | 8/1972 | Nora et al. | 204/290 F |
| 3,837,879 | 9/1974 | Sluse et al. | 204/290 F |

*Primary Examiner*—T. Tung

*Attorney, Agent, or Firm*—Sim & McBurney

[57] ABSTRACT

An electrode having a conductive platinum alloy coating and which has deteriorated in use in an electrolytic chlorate cell is heat treated at elevated temperatures of above 300° C to regenerate the coating. The regeneration of the coating is exhibited by a decreased oxygen concentration in the cell off gases after the heat treatment. Further improvement in cell characteristics in severely deteriorated anodes may be achieved by coating the anode surface with a platinum group metal prior to or during the heat treatment.

5 Claims, No Drawings

TREATMENT OF CELL ANODES

FIELD OF INVENTION

The present invention relates to the treatment of cell electrodes, more particularly to the treatment of metal anodes used in chlorate cells.

BACKGROUND TO THE INVENTION

In the production of sodium chlorate, an aqueous solution of sodium chloride is electrolyzed in a diaphragmless cell and the liquid products of electrolysis are allowed to react to form sodium chlorate. The overall reaction may be represented as follows:

$$NaCl + 3H_2O \rightarrow NaClO_3 + 3H_2$$

Generally, small amounts of oxygen are formed at the anode surface due to side reactions and the evolved oxygen appears in the hydrogen off-gas stream at concentrations of the order of 1 to 2% of the total off-gas volume. The formation of oxygen in this way represents a loss of potential chlorate product, and hence the larger the amount of oxygen produced, the more inefficient is the cell.

Platinum alloy-coated titanium electrodes have been used as anodes in chlorate cells and, particularly, in the case of platinum-iridium alloy coated electrodes, in some instances, upon extended use greater than normal oxygen production has been observed, typically about 3½ to 4% oxygen in the off-gas stream, representing a deterioration of the efficiency of the electrode.

SUMMARY OF THE INVENTION

In accordance with the present invention, an electrode having a deteriorated conductive platinum alloy coating is heat treated to regenerate the coating.

GENERAL DESCRIPTION OF INVENTION

The invention is particularly useful with platinum-iridium alloy conductive coatings provided on passivatable metal supports, especially titanium metal anodes having a continuous or discontinuous conductive platinum-iridium alloy electrode surface.

While the invention is applicable to a variety of platinum-iridium alloy coatings, the invention has particular utility with the commercially-available platinum-iridium alloy having a weight ratio of platinum to iridium of 70:30.

The heat treatment may be carried over a wide range of conditions, typically above about 300° C up to a temperature below that above which the surface is adversely affected preferably at a temperature in the range of about 350° to about 500° C, particularly at about 500° C.

The length of time for which the anode is heated varies depending on the degree of deterioration of the electrode, the temperature utilized and the degree of regeneration desired. Times may vary from as little as about 5 minutes to over 24 hours, typically up to about 4 or 5 days. Longer periods of time are preferred since these appear to provide a greater improvement than shorter periods of time in most cases.

The improvement in the electrolytic properties of the electrode surface on heat treatment is manifested by a decreased oxygen presence in the cell off-gases.

It has also been found that in addition to the oxygen evolution improvement, the anode voltage requirement is decreased by the heat treatment but in some instances this latter improvement tends to deteriorate in time.

However, it has been found that in those cases where the anode voltage requirement increases on extended use after the heat treatment, coating or painting the anode surface with one or more platinum group metals, typically platinum or platinum and iridium, prior to, or during, the heat treatment, results in a decreased anode voltage requirement which is sustained on prolonged reuse.

The painting of the anode surface may be achieved using an aqueous solution of one or more soluble platinum group metal compounds which readily decompose to the metal platinum and a volatile compound, typically the compounds being in the form of chlorides or organic complexes. A suspension of the metal or metals also may be used. When used in the painting step, the solution or suspension of the platinum group metal or metals preferably has physical characteristics which make it easily spread to a uniform coating.

EXAMPLES

EXAMPLE 1

A platinized titanium anode in which a 70:30 platinum-iridium alloy provided the conductive surface was found in service in a sodium chlorate-producing electrolytic cell to have deteriorated and the observed oxygen concentration in the off-gas stream was 1.5%$O_2$ greater than the %$O_2$ concentration observed in the off-gas stream of a cell using an undeteriorated electrode.

The electrode was cut into several pieces and each piece was subjected to heat treatment at various temperatures and for various time periods. After completion of its heat treatment, the sample was used as an anode in an experimental chlorate cell and the concentration of oxygen present in the cell off-gases was determined and compared to that of the undeteriorated electrode.

The results obtained are reported in the following Table I:

TABLE I

| Temperature (° C) | Time (Min.) | Increase in %$O_2$ |
|---|---|---|
| No treatment | — | 1.5 |
| 500 | 5 | 0.71 |
| 500 | 20 | 0.93 |
| 500 | 90 | 0.36 |
| 500 | 360 | 0.45 |
| 500 | 24 hrs. | 0.25 |
| 350 | 120 | 0.8 |
| 400 | 120 | 0.33 |
| 450 | 120 | 0.35 |
| 550 | 120 | 0.4 |

It will be seen from the above Table that heat treatment for as short as five minutes at 500° C produces a significant improvement and that a 24-hour treatment at that temperature produces almost total regeneration of the electrode.

EXAMPLE II

Samples of the electrode pieces of Example I were examined and found to have 5 to 7 g/sq.m. of platinum-/iridium alloy on the anode surface, as compared with about 20 g/sq.m of the alloy in a new electrode.

Some of these samples were treated at 500° C for 1 day and 4 days and the anode voltage characteristics in a cell using the treated electrodes were observed over a period of time. Another sample was heat treated at 500° C for 4 days and then was contacted with a platinum chloride solution in dilute HCl followed by decomposition of the salt to provide on the surface an increase in the amount of platinum of about 6 g/sq.m. Thereafter, the coated sample was heat treated at 500° C for 1 day. Again the anode voltage characteristics were observed. In each case, the oxygen concentration of the cell off-gases was determined periodically.

The results obtained are reproduced in the following Table II:

TABLE II

| Treatment | Anode Voltage | Oxygen Evolution |
|---|---|---|
| none | 3.4 to 3.44 | 2.7% |
| 500° C for 1 day | 1.97 rising to 2.86 in 5 hrs. | 1.2% |
| 500° C for 4 days | 1.48 rising to 1.69 in 7 days | 0.8 to 1.0% |
| 500° C for 4 days + Pt solution + 500° C for 1 day | 1.13 rising to 1.15 in 12 days | 0.6 to 1.0% |

It will be seen from the above results that the platinum painting of the deteriorated anode led to sustained improvement in anode voltage characteristics as well as exhibiting decreased oxygen concentration in the cell off-gases.

EXAMPLE III

Electrodes which had been heat treated in accordance with the procedure of Example 1 were used in a continuously-operating sodium chlorate-producing electrolytic cell over a five month period and the oxygen concentration of the off-gases was periodically determined. While the oxygen concentration of the gas varied from about 1.1 to about 1.7% over this time period, averaging about 1.3%, there was no evidence of a tendency for the oxygen concentration to increase in that time.

EXAMPLE IV

A failed electrode having a 70:30 platinum-iridium alloy face on both sides were cut into two separate sample pieces. One of the samples was coated on one side only with a solution of $PtCl_4$ in dilute HCl followed by decomposition of the salt to provide an amount of platinum equivalent to about 6 g/sq.m. on the one side. Both samples then were heated at 500° C for 4 days.

The second sample then was coated on one side only identically to the first sample and both samples were heated at 500° C for an additional day. Following this treatment, the samples were tested in a sodium chlorate-producing electrolytic cell over a period of time and the anode voltage and oxygen concentration in the off-gases were periodically determined.

The results obtained appear in the following Table III:

TABLE III

| Sample | Duration of Test (Days) | Anode Voltage | Oxygen Evolution |
|---|---|---|---|
| No. 1 coated side | 2 | 1.18 to 1.22 | 0.92 to 1.39% |
| No. 2 coated side | 2 | 1.24 | 1.06 to 1.12% |
| No. 1 non-coated side | 9 | 1.19 to 1.30 | 0.77 to 1.54% |

The results of the above Table III indicate that the anode samples treated in this Example had not deteriorated to such a severe extent that platinum coating as well as heat treatment was required to provide an anode of decreased voltage requirement which is sustained on prolonged use, in contrast to the samples tested in Example II above.

Modifications are possible within the scope of the invention.

What I claim is:

1. A method of treatment of an electrode having an anodic platinum-iridium alloy surface which has deteriorated in use in the electrolysis of sodium chloride solution to form sodium chlorate and gaseous by-products to the extent that a volume of oxygen of about 3½ to 4% is present in said gaseous by-products, which comprises subjecting said electrode surface to an elevated temperature of from about 350° to about 550° C for a time period of from about 5 minutes to about 5 days to provide an electrode having an improved platinum-iridium alloy surface which when used in said electrolysis results in a volume of oxygen of about 1 to 2% in said gaseous by-products.

2. The method of claim 1 wherein said electrode surface is provided on a passivatable metal support.

3. The method of claim 2 wherein said passivatable metal support is titanium.

4. The method of claim 1 wherein said platinum-iridium alloy is one containing about 70 parts platinum and about 30 parts iridium.

5. The method of claim 1 wherein a coating of at least one platinum group metal is provided over at least part of said electrode surface prior to or during said heat treatment.

* * * * *